US008002050B2

(12) United States Patent
Frazier

(10) Patent No.: US 8,002,050 B2
(45) Date of Patent: Aug. 23, 2011

(54) COMPLETION TECHNIQUE AND TREATMENT OF DRILLED SOLIDS

(76) Inventor: W. Lynn Frazier, Corpus Christi, TX (US)

( * ) Notice: Subject to any disclaimer, the term of this patent is extended or adjusted under 35 U.S.C. 154(b) by 100 days.

(21) Appl. No.: 12/387,595

(22) Filed: May 5, 2009

(65) Prior Publication Data

US 2009/0277632 A1 Nov. 12, 2009

Related U.S. Application Data

(60) Provisional application No. 61/126,552, filed on May 6, 2008.

(51) Int. Cl.
*E21B 21/06* (2006.01)

(52) U.S. Cl. ..... 175/66; 175/207; 175/206; 405/129.2; 405/129.95

(58) Field of Classification Search ..... 175/66, 175/206, 207, 209, 212, 88, 161, 172; 210/669, 210/680, 804; 134/6, 40, 42; 166/267; 405/129.2, 405/129.95, 129.1; 588/249
See application file for complete search history.

(56) References Cited

U.S. PATENT DOCUMENTS

| | | | | |
|---|---|---|---|---|
| 2,941,783 | A | 6/1960 | Stinson | |
| 3,384,169 | A | 5/1968 | Leonard | |
| 4,063,386 | A | 12/1977 | Tramier | |
| 4,429,754 | A | 2/1984 | Cormier | |
| 4,440,243 | A | 4/1984 | Howeth | |
| 4,480,702 | A * | 11/1984 | Kelly, Jr. | 175/66 |
| 4,832,852 | A * | 5/1989 | Wells et al. | 210/671 |
| 5,132,025 | A | 7/1992 | Hays | |
| 5,232,475 | A | 8/1993 | Jepson | |
| 5,289,845 | A * | 3/1994 | Sipos et al. | 137/355.27 |
| 5,609,667 | A * | 3/1997 | Dickerson | 71/6 |
| 6,279,471 | B1 | 8/2001 | Reddoch | |
| 6,391,195 | B1 | 5/2002 | Layton | |
| 6,835,697 | B2 * | 12/2004 | Von Krosigk | 507/104 |
| 6,838,082 | B2 | 1/2005 | Growcock | |
| 6,852,675 | B2 * | 2/2005 | Von Krosigk | 507/104 |
| 6,875,728 | B2 * | 4/2005 | Gupta et al. | 507/240 |
| 7,048,058 | B2 | 5/2006 | Ostergaard | |
| 7,048,060 | B2 | 5/2006 | Ostergaard | |
| 7,152,682 | B2 | 12/2006 | Hopper | |
| 7,160,474 | B2 | 1/2007 | Harding | |
| 2007/0221411 | A1 | 9/2007 | Butler | |
| 2007/0278012 | A1 | 12/2007 | Smith | |
| 2008/0083566 | A1 | 4/2008 | Burnett | |
| 2008/0173453 | A1 * | 7/2008 | Misselbrook | 166/311 |
| 2008/0196896 | A1 * | 8/2008 | Bustos et al. | 166/281 |

* cited by examiner

*Primary Examiner* — Shane Bomar
*Assistant Examiner* — Kipp Wallace
(74) *Attorney, Agent, or Firm* — G. Turner Moller

(57) ABSTRACT

An onshore oil or gas well is completed with a coiled tubing unit. A completion liquid is circulated through coiled tubing and thereby removing solids from the well. The completion liquid and drilled solids pass into a tank where the solids are removed and the cleansed completion liquid is redelivered into the well. In some embodiments, drilled solids from the completion liquid are dewatered to a suitable extent in the tank and dumped into a bin where they are mixed with cotton motes to sorb any free liquid. In some embodiments, drilled solids from drilling an onshore subterranean well are mixed with cotton motes to sorb free liquid. The mixture of cotton motes and drilled solids are disposed of in a manner consistent with appropriate regulations, as by delivery to a commercial landfill, which may be either privately or municipally owned.

14 Claims, 2 Drawing Sheets

COMPLETION TECHNIQUE AND TREATMENT OF DRILLED SOLIDS

This application is based, in part, on Provisional Application Ser. No. 61/126,552, filed May 6, 2008, on which priority is claimed.

This invention relates to a technique for completing oil and gas wells and a technique for treating drilled solids from a well.

BACKGROUND OF THE INVENTION

In the past, all onshore or offshore oil and gas wells were completed by cementing a casing string in a well and then using a workover rig to perform various operations including the running of a tubing string in the well through which oil or gas was produced. Workover rigs are often equipped with a tank into which completion liquids or well liquids are discharged, such as when the well is swabbed.

Many years ago, the practice called tubingless completions developed where, in onshore wells, a string of tubing was cemented in the well bore and using a slick line unit, swabbing unit or logging truck to complete the well. Typically, drilling mud is present inside the tubing string when the completion unit arrives at the well site because drilling mud is used to pump the second plug of a cementing operation downwardly into the well. Because of the nature of tubingless completions, the only things that have to be done in a completion attempt is run a cased hole log, perforate the desired interval and swab the well to relieve the hydrostatic load on the productive formation. Thus, the production string is swabbed or the well produced, at some stage of the proceedings, so the drilling mud is discharged from the well, either into an earthen pit, metal tank or vacuum truck.

Current high tech onshore wells, both vertical and horizontal, are completed differently. Typically, a string of pipe is cemented in the well bore and the well completed with a coiled tubing unit. Most high tech wells are completed in tight sands or shales which were not considered productive until the advent of multiple high volume frac jobs so many completion operations include fracing multiple zones penetrated by the well bore. In one conventional technique, a first lower zone is perforated and fraced, a bridge plug is set above the fraced zone, a second higher zone is perforated and fraced, a bridge plug is set above the second fraced zone and this process is repeated to perforate and frac a series of productive zones. In the process of drilling out the bridge plugs or other completion equipment, any frac sand deposited on top of a bridge plug is circulated out of the well. There are other completion techniques for modern high tech onshore wells but all of them use a coiled tubing unit to remove frac sand from the well and to drill up completion equipment inside the well.

A completion liquid, typically 2% potassium chloride in water, is typically pumped down the coiled tubing to rotate the bit and circulate drilled solids. Typically, circulation is up the annulus between the coiled tubing and the inside of the casing string although sometimes it is down the annulus and up the tubing. Universally, a vacuum truck containing uncontaminated completion liquid is a source for the liquid pumped into the well. Completion liquid and drilled solids are discharged into a second vacuum truck. When the first vacuum truck empties, the second vacuum truck is normally full so the flow connections leading from the well are changed so the first vacuum truck becomes the collection truck and a third vacuum truck having a fresh load of uncontaminated completion liquid is connected as the supply source. The amount of completion liquid used in these type wells depends on the number of bridge plugs that have to be drilled out, the amount of frac sand collected on top of the bridge plugs and the like but it would not be unusual to consume 1000 barrels of completion liquid in completing a modern high tech well. This has its cost because the completion liquid must be bought, the vacuum trucks hired and the completion liquid disposed of.

It is not known how many wells have been completed using a coiled tubing unit in this manner. What is known is this technique has been used extensively by knowledgeable and experienced companies and field personnel—no inexperienced person is given the responsibility of such efforts. Estimates of knowledgeable people vary between tens of thousands and hundreds of thousands of wells have been completed using coiled tubing units in this manner in the last decade.

Relating to another feature of the method and apparatus disclosed herein, when the bore hole of an onshore or offshore oil or gas well is drilled, drilling mud is circulated down the drill string and up the annulus between the drill string and the well bore. This accomplishes several purposes, one of which is the removal of rock particles, known as cuttings or drilled solids, from the face of the bit so the bit is working on uncut rock rather than grinding away on chips that have already broken off the rock face. When the drilling mud reaches the surface, it may be handled in a variety of ways, depending usually on the size of the rig and the depth of the well being drilled.

In the past, when drilling shallow onshore wells with small rigs, the drilling mud and cuttings were discharged into an earthen pit where larger particles drop out of suspension. The mud passes into a second pit where smaller particles drop out of suspension, chemicals are added to the mud and a pump delivers the treated mud back to the drill string. This practice is now been superseded by the use of mud tanks because regulatory agencies, in most jurisdictions, have basically outlawed the use of earthen pits.

Current practice has been to adopt, for all onshore wells, what was heretofore used only in deeper onshore wells drilled with larger rigs. In other words, the drilling mud and cuttings are discharged into a tank where the mud is treated by removing drilled solids from the mud so chemicals may be added before the mud is pumped back into the drill stem. Mud tanks are of a variety of different types but all have some means of removing drilled solids from liquid mud and discharging drilled solids from the tank. Usually, some of the drilled solids drop out of suspension simply by a reduction in velocity of the mud and then the mud may be delivered to centrifuges or cyclones where smaller particles are removed. U.S. Pat. No. 7,160,474 discloses one such mud tank where drilled solids settle out and are then removed from the mud tank by one or more augers. The drilled solids removed from this tank, or from any tank, are in the form of a thick slurry comprising a substantial amount of drilled solids, a considerable amount of liquid mud sorbed on the drilled solids and some free liquid. Considerable effort may be spent to recover as much of the liquid mud as feasible because it contains expensive materials and reduces the volume of material and thus its disposal cost. Thus, drilled solid slurries are often sent through a cyclone, centrifuge or similar device to remove a greater quantity of liquid than can be removed by settling alone.

In the past, drilled solid slurries, from onshore mud tanks were put in what is known as a reserve pit which comprised a earthen wall enclosing a ground level storage area. After the well was completed and the drilled solids slurry dried out, the earthen wall was breached and the remaining material and the earthen wall were mixed and spread over the land. This practice has been basically outlawed where the drilling mud is an oil based mud and these drilled solids, in most jurisdictions, must now be disposed of in a more formal manner. The situation is different where the drilling mud is a water based mud and different states have different requirements.

At the current time, drilled solids from onshore wells drilled with oil based muds are discharged from the mud tank into a shale bin or receptacle on or near the mud tank. Sand or dirt is mixed with a drilled solids slurry to sorb the remaining free liquid so the resultant material may be delivered to, and disposed at, a landfill or similar disposal site. As used herein, the word "sorb" is intended to be a generic term to include "absorb" and "adsorb" because it may not be clear exactly which mechanism is at work. Commercial landfills, either municipally owned, owned by public companies or privately owned, often will not accept slurries, i.e. the material has to have no free liquid. Slurries may have to be disposed of at hazardous material depositories which involve considerable cost.

The amount of drilled solids trucked away from a well site during the drilling process is quite substantial and a large proportion of the disposed material is the sand or dirt added to the drilled solids to sorb any free liquid. In a typical 9000' onshore well, about three hundred fifty cubic yards of drilled solids—sand mixture may be hauled away to a landfill for disposal.

One can readily calculate the volume of drilled solids from a wellbore, within a reasonable degree of error, by calculating the volume of the drilled hole. For example, a typical 9000' well in South Texas might drill a 12¼" surface hole to 2000' and set surface pipe, drill a 9⅝" hole to 7000' and set 7⅝" intermediate casing and drill a 6¼" hole to T.D. A calculation of the volume of rock removed from the earth using a 15% washout factor for the surface hole reveals that the rock volume removed from the earth, based on the above assumptions, is about 190 cubic yards. The volume of the drilled hole is always smaller than the amount of cuttings generated because the cuttings, by definition, are not packed as closely as the undrilled rock. This typically amounts to an increase in volume by 20-30%. Thus, in the above example, the volume of the cuttings would likely be about 225-245 cubic yards. The amount of sand or dirt varies significantly, but it may be as much as an additional 40-50% by volume. Thus, a large fraction of the difference between a calculation of rock volume drilled and the amount of material actually hauled away will be the amount of sand or dirt used to soak up free liquid.

As used herein, the phrase drilled solids means rock cuttings, debris from comminuted well parts, frac sand, mill scale and other debris found in wells at a time when they are completed.

Disclosures of interest relative to this invention are found in U.S. Pat. Nos. 2,714,932; 2,756,827; 2,941,783; 3,282,342; 3,291,218; 3,384,169; 3,393,743; 3,429,375; 3,554,280; 4,429,754; 4,440,243; 5,132,025; 5,232,475; 5,311,939; 5,419,399; 6,769,491; 6,863,809; 7,021,389; 7,048,058; 7,048,060; 7,152,682; 7,160,474 and 7,350,582 along with printed patent application 2008/0060821.

SUMMARY OF THE INVENTION

In accordance with one aspect of the method and apparatus disclosed herein, an onshore well is completed using a coiled tubing unit to drill up and/or circulate out bridge plugs, other completion equipment inside the well, frac sand and/or other debris. The drilled solids from the well are delivered to a tank where solids are removed and the completion liquid is recirculated. Clean completion liquid is withdrawn from the tank, and in some embodiments, pumped through coiled tubing run into the well and then through the annulus between the coiled tubing and the casing and then back into the tank. In the tank, drilled solids may be removed from the completion liquid by one or more processes and then discharged into a bin or receptacle. The completion liquid may accordingly be reused so the total volume used may be much reduced. Typically, a hundred barrels of completion liquid may suffice for completing a well in accordance with the method and apparatus disclosed herein regardless of how many bridge plugs have been drilled up or how much frac sand is circulated out of the well. After the well is finished and the drilled solids removed, the completion liquid may be used in the next well.

Although the drilled solids must be disposed of, their volume is much less than the volume of completion liquid and drilled solids disposed of in the prior art. If the completion liquid can be reused, the volume of drilled solids from a completion operation is small compared to the volume of prior art contaminated completion liquid. Even if the completion liquid has to be disposed of, rather than reused, the savings in volume to be disposed of is often as high as 90%. In disposing of drilled solids from a completion operation, the vast majority of the volume is frac sand which has accumulated on top of the bridge plugs.

It will thus be apparent that the volume of drilled solids, from either onshore drilling operations, offshore drilling operations or onshore completion operations, is substantial and the cost of disposal is directly proportional to the volume of the drilled solids. Rather than mixing the drilled solids slurry with a large amount of sand or dirt, as may be the prior art practice in the completion of onshore wells or in the drilling of onshore wells, the slurry is mixed with cotton motes which have a substantial capability of sorbing the free liquid. The main advantage is the reduction in volume, or weight, of the solids taken to a landfill while producing a material that is acceptable to the landfill operator, i.e. it passes their tests or meets their requirements. Using cotton motes to sorb free liquid from the drilled solids produces, in a typical 9000' well, about two hundred seventy five cubic yards of drilled solids—motes mixture to be hauled away to a landfill for disposal. The cost of the sand and the cost of hauling it to the location is considerably greater than the cost of the cotton motes and hauling it to the location. In addition, the savings in disposal costs is typically directly proportional to the volume of material to be disposed of. Thus, in a typical 9000' well, savings on the order of 25-30% are common.

In many onshore completion situations, the volume of drilled solids and completion liquid disposed of in accordance with the method and apparatus disclosed herein is reduced by 75-90% over the prior art technique. In many onshore drilling situations, the volume of drilled solids disposed of in accordance with the method and apparatus disclosed herein is reduced by 25-30% over the prior art technique.

DETAILED DESCRIPTION OF THE INVENTION

Treatment of completion liquids, drilling mud and drilled solids may be done in any suitable manner and the following description involving the disclosure in U.S. Pat. No. 7,160,474 is by way of example only, it being understood that a drilled solids slurry from any well operation may be handled in accordance with the teachings herein using a tank of any description, either with or without additional cyclones, centrifuges or other powerful separation techniques.

Figure 1:
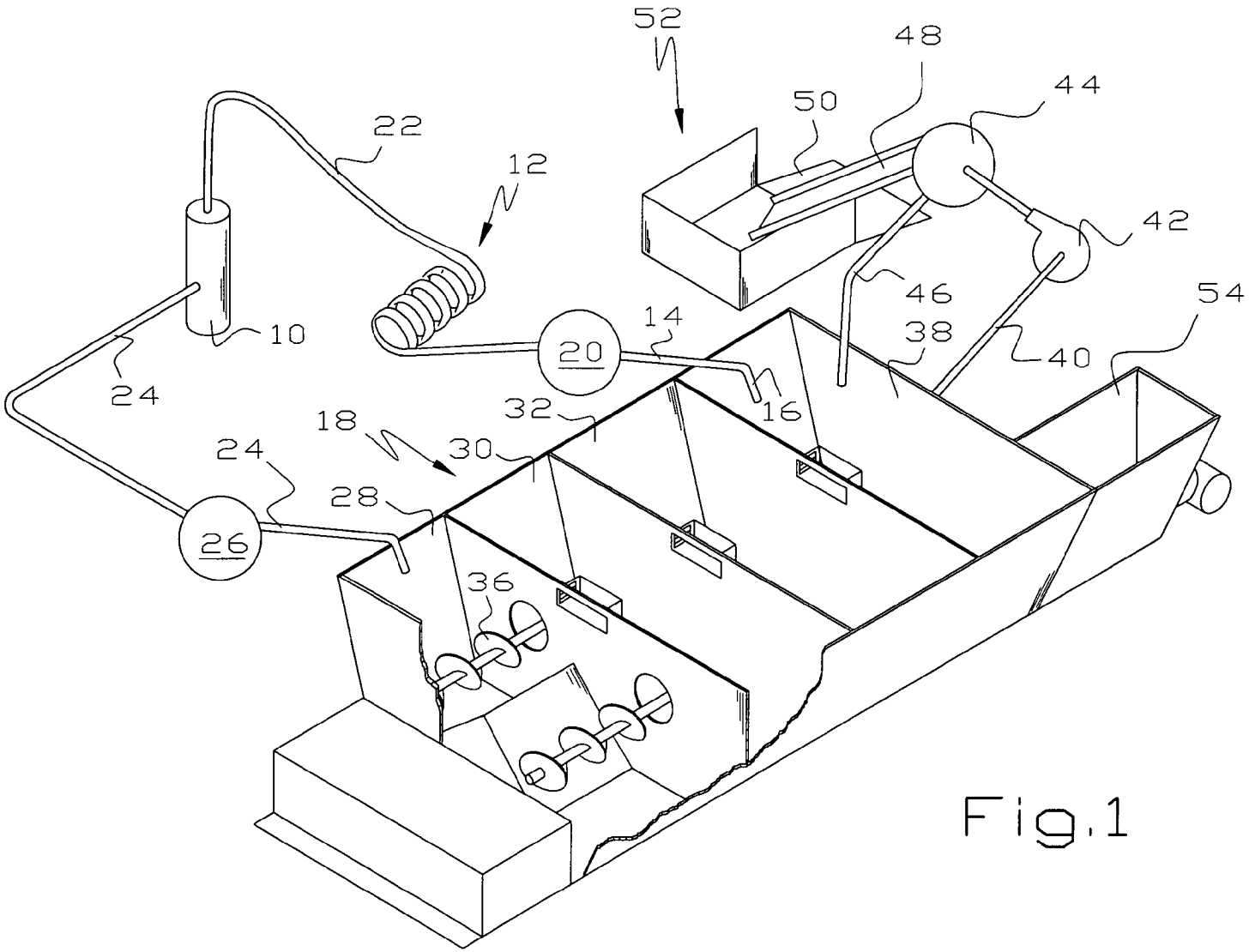
FIG. 1 is an isometric view of a mud tank of the type shown in U.S. Pat. No. 7,160,474 shown in a fluid circuit with a coiled tubing unit.

Referring to FIG. 1, there is illustrated a subterranean onshore well 10, which is normally an oil or gas well, in the process of being completed by a coiled tubing unit 12. Coiled tubing units are well known in the art, are commercially available from such manufacturers as C-Tech Design and Manufacturing of Edmonton, Alberta, Canada and Stewart and Stevenson of Houston, Tex. In addition, coiled tubing services are available from a number of oil field service companies such as BJ Services, Schlumberger, Cudd, IPS and Halliburton, all of Houston, Tex. Coiled tubing units 12 are wheeled for purposes of mobility, i.e. they are either truck mounted or trailer mounted so they travel by road to the onshore well 10. A flow line 14 includes an inlet 16 in one of the downstream compartments of a tank 18 and delivers completion liquid to a pump 20 which delivers high pressure completion liquid through coiled tubing 22 which passes into the well 10. When completion liquid is being circulated through the onshore well 10, it normally means that frac sand, bridge plugs and/or other downhole well components are being drilled up and/or circulated out of the well 10. Completion liquid and drilled solids exit the well 10 through a flow line 24 and may preferably pass through a gas buster 26 located near or on the tank 18.

The gas buster 26 may be of any suitable type and typically is a simple gas-liquid separator comprising a vessel having one or more baffles therein allowing gas to escape from the completion liquid discharging from the well 10. Those skilled in the art will recognize the coiled tubing unit 12, the flow lines 14, 24, the pump 20 and the gas buster 26 to be of types conventional in the industry.

Reference is made to U.S. Pat. No. 7,160,474, the disclosure of which is incorporated herein, for an explanation of the operation and construction of the tank 18, it being understood that any suitable tank may be employed in the method and apparatus described herein. For present purposes, the tank 18 may include an inlet compartment 28 receiving completion liquid from the well 10, one or more intermediate compartments 30, 32 and a final or discharge compartment 34 from which clean completion liquid is removed through the flow line inlet 16. As will be apparent to those skilled in the art, solids fall of out suspension from the completion liquid due to a variety of separation techniques and are conveyed by any suitable device, such as one or more augers 36, through an end wall 38 of the tank 18 into communication with an inlet 40 to a pump 42 discharging a high solids content slurry to a centrifuge, cyclone or other similar high efficiency separator 44. The separator 44 delivers clean completion liquid through an outlet 46 into the compartment 34 and delivers solids onto a chute 48 which directs the solids into a bin or receptacle 50. The bin 50 may preferably have an openable side 52 acting as a ramp so a front end loader (not shown) or backhoe (not shown) can enter the bin to remove drilled solids and, in some embodiments, to mix cotton motes with the drilled solids as will be explained hereinafter.

Operation of the system of FIG. 1 will now be described. The coiled tubing unit 12 circulates completion liquid from the pump 20 downwardly into the onshore well 10, typically downwardly through the coiled tubing 22 and up the annulus between the coiled tubing 22 and the well 10, but sometimes down the annulus between the coiled tubing 22 and up the coiled tubing. In either case, a mixture of completion liquid and solids pass through the flow line 24 and through the gas buster 26 where any entrained gas escapes from the mixture. The mixture passes into the inlet compartment 28 of the tank 18 and then successively through one or more intermediate compartments 30, 32 where most of the solids fall out of suspension, leaving clean completion liquid in the compartment 34.

Thus, clean completion liquid is recirculated through the well 10 while drilled solids, such as drilled up bridge plugs or other completion equipment and frac sand are circulated out of the well 10, pass through the pump 42 and into the centrifuge 44. Clean liquid exits through the liquid outlet 46 back into the tank 18 and a solids rich slurry passes into the bin 50. In the event any additional chemicals need to be mixed or added to the completion liquid, such as the preparation of a gel pill, a mixing tank 54 may be provided.

In some embodiments, cotton motes and the drilled solids slurry are mixed in the bin 50 in any suitable manner. One simple technique is to add the cotton motes with a front end loader or back hoe. The cotton motes and drilled solids are then mixed together in any suitable manner. A particularly inexpensive approach is to provide the bin 50 with an openable side 52 and use a front end loader or back hoe to spread, tumble or push the material with the bucket of the loader/back hoe until all free liquids are sorbed by the cotton motes. More sophisticated mixing techniques may be used, such as providing an auger (not shown) in the bin 50, a tilted drum which is rotatable on its tilted axis, delivering the drilled solids slurry and cotton motes into the upper end and collecting the mixed material at the lower end. The front end loader or backhoe may then empty the bin into a suitable truck for hauling to a landfill.

In academic circles, the phrase "cotton motes" means cotton ovules that fail to ripen into mature seeds. To practical cotton men, and as used herein, motes or cotton motes are the byproduct of the lint cleaning process after the cotton seed has been removed from the cotton and are fibers usually too short for conventional textile use. In other words, the cotton motes of practical cotton men include the cotton motes of academics as well as very short staple cotton. Cotton motes are conventionally collected by cotton gins and have a variety of conventional uses, such as stuffing in mattresses, paper, nonwoven wipes, animal feed and coarse yarn spinning. Cotton motes are inexpensive because supply swamps demand.

Cotton motes are highly absorbent, meaning that a relatively small volume of motes readily sorb free liquid from the solids in the bin 50. Published information suggests that cotton can sorb up to twenty seven times its weight in water. By comparison, the absorbency of saw dust depends on the type wood and its granule size but typically lies in the range of 40-70% by volume.

Thus, the total volume and weight, of the solids and motes removed from the bin 50 is much lower than using sand, dirt or other absorbent materials such as saw dust. Another important advantage of cotton motes is they are readily available and inexpensive in almost all parts of Texas, Louisiana and Oklahoma where a great deal of oil and gas well drilling occurs.

Figure 2:
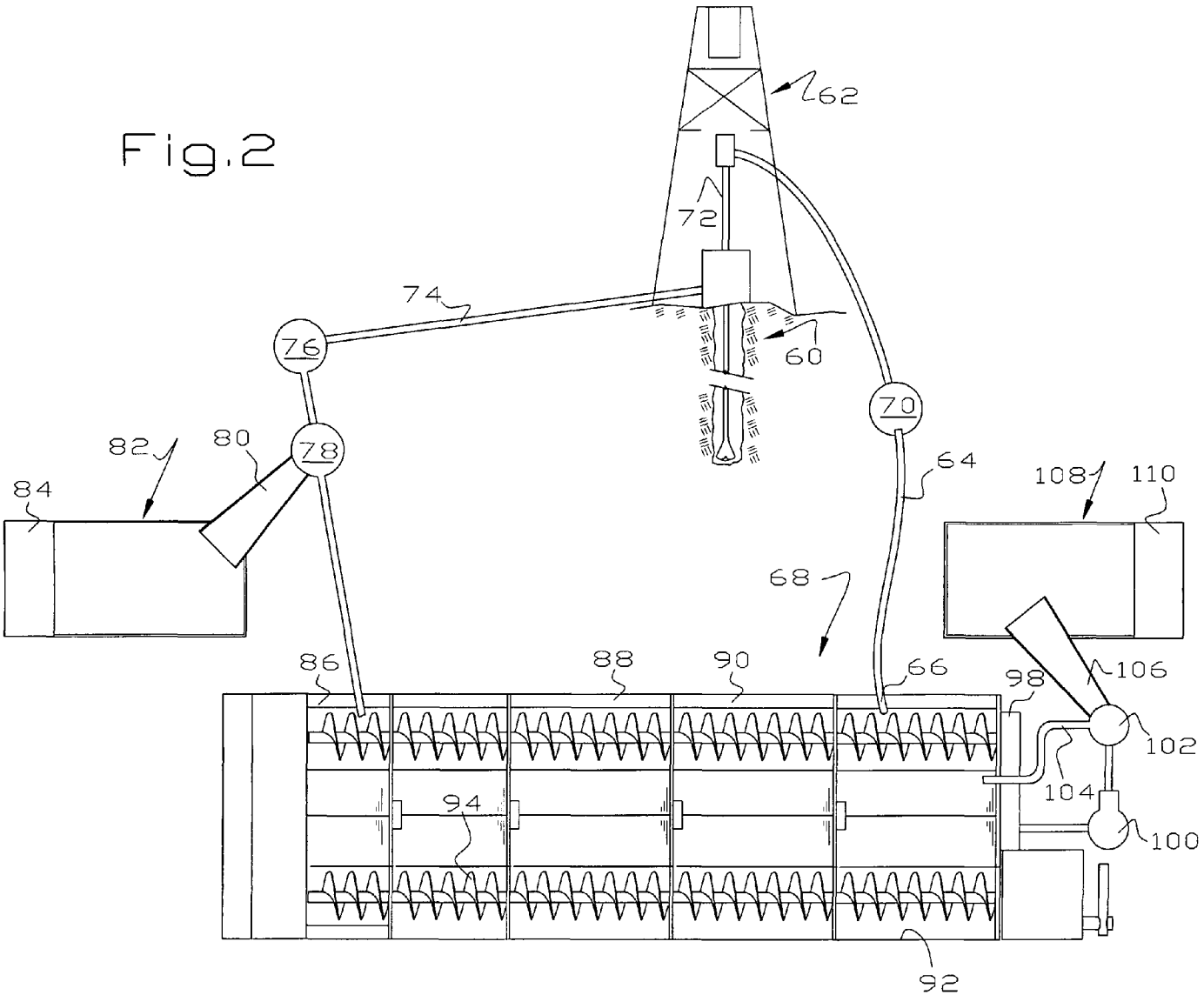
FIG. 2 is a top view of a mud tank shown in fluid circuit with a drilling rig in the process of drilling a well.

Referring to FIG. 2, an onshore subterranean well 60, which is normally an oil or gas well, is being drilled by a drilling rig 62. A flow line 64 includes an inlet 66 in one of the downstream compartments of a tank 68 and delivers drilling mud to a mud pump 70 which delivers high pressure drilling mud downwardly through a drill string 72 which passes into the well 60. Drilling mud and drilled solids exit the well 60 through a flow line 74 and pass through a gas buster 76 and shale shaker 78 located near or on the tank 68.

The gas buster 76 may be of any suitable type and typically is a simple gas-liquid separator comprising a vessel having one or more baffles therein allowing gas to escape from the completion liquid discharging from the well 60. The shale shaker 78 includes a chute 80 discharging large solid particles into a bin 82 which may be similar to the bin 50, i.e. having a side wall 84 which lays down as a ramp. Those skilled in the art will recognize the drilling rig 62, the flow lines 64, 74, the pump 70, the gas buster 76 and the shale shaker 78 to be of types conventional in the industry. Those skilled in the art will also recognize that the drilling mud may be of any suitable type, most being either water based or oil based slurries.

The tank 68 is also illustrated as similar to the tank shown in U.S. Pat. No. 7,160,474 to which reference is made for a more complete disclosure of the construction and operation of the tank 68. The tank 68 may include an inlet compartment 86 receiving drilling mud from the shale shaker 78, one or more intermediate compartments 88, 90 and a final or discharge compartment 92 from which clean drilling mud is removed through the flow line inlet 66. As will be apparent to those skilled in the art, solids fall of out suspension from the drilling mud due to a variety of separation techniques and are conveyed by any suitable device, such as one or more augers 94 through an end wall of the tank 68 into communication with an inlet 96 into a manifold 98 in communication with a pump 100 discharging a high solids content slurry to a centrifuge, cyclone or other similar high efficiency separator 102. The separator 102 delivers clean completion liquid through an outlet 104 into the compartment 92 and delivers solids onto a chute 106 which directs the solids into a bin or receptacle 108 which may be same as the bin 82 or a separate bin. The bin 108 may preferably have an openable side 110 acting as a ramp so a front end loader (not shown) or backhoe (not shown) can enter the bin to remove drilled solids and to mix cotton motes with the drilled solids.

Operation of the system of FIG. 2 will now be described. The drilling rig 62 and its mud pump 70 circulate drilling mud downwardly into the onshore well 60 and up the annulus between the drill string 72 and the well 60. A slurry of drilling mud and drilled solids pass through the flow line 74, through the gas buster 76 where any entrained gas escapes and through the shale shaker 78. The slurry passes into the inlet compartment 86 of the tank 68 and then successively through one or more intermediate compartments 88, 90 where most of the solids fall out of suspension, leaving clean drilling mud in the compartment 92.

Thus, clean drilling mud is recirculated through the onshore well 60 while a thick slurry of drilled solids and drilling mud passes out of the tank 68 via one or more of the augers 94, through the pump 100 into the centrifuge 102. Clean liquid exits through the liquid outlet 104 back into the tank 68 and a solids rich slurry passes into the bin 108. Cotton motes and the drilled solids slurry are mixed in the bin 108 in any suitable manner, as described previously, to sorb free liquid from the drilled solids. This produces a dry material that is acceptable to municipal, publicly or privately owned landfills that is much reduced in volume and weight from prior art practices. Because the drilling mud may be either oil based or water based, separating the slurry of drilled solids and drilling mud with a high efficiency separator recovers much of the liquid drilling mud which may contain costly materials. The front end loader or backhoe may then empty the bin into a suitable truck for hauling to a landfill in the case of an onshore well. Drilled solids are handled much differently in offshore wells, i.e. they are either pumped into a section of open hole or cleaned up and dumped into the water adjacent the rig. They normally are not hauled away.

Thus, the total volume, and weight, of the solids removed from the bin 108 is much lower than using sand, dirt or other absorbent materials such as saw dust. Using cotton motes to sorb the free liquid in drilled solids on an onshore 9000' well comparable to the prior art example above, the volume hauled away was eight truck loads as compared to thirty. This amounted to a cost reduction of about 75% of the cost of buying sand, hauling it to the well site, mixing it with the drilled solids, hauling the mixture to a disposal site and paying its operator to dispose of the mixture.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of completing a subterranean onshore well with a coiled tubing unit after a production string has been cemented in the well comprising setting completion equipment in the production string and thereafter fracing a zone through the production string;

after fracing the zone, drilling up the completion equipment with a cutting element on coiled tubing from the coiled tubing unit;

circulating a completion liquid through the production string and through coiled tubing from the coiled tubing unit and thereby removing solids including frac sand from the production string;

passing the completion liquid and solids into a tank and separating the completion liquid from the solids;

redelivering the completion liquid from the tank through the production string and through coiled tubing from the coiled tubing unit;

discharging solids from the tank; and mixing cotton motes with the frac sand and sorbing free liquid from the frac sand;

disposing of a mixture of the cotton motes and solids by trucking the mixture to a commercial landfill.

2. The method of claim 1 wherein circulating and redelivering the completion liquid comprises pumping the completion liquid down the coiled tubing and up through an annulus between the coiled tubing and the production string.

3. The method of claim 1 wherein the completion equipment comprises at least one bridge plug.

4. The method of claim 1 wherein the coiled tubing unit is wheeled.

5. A method of treating solids from an onshore well comprising delivering a liquid into the onshore well and discharging a mixture containing the solids from the onshore well into a tank;

separating the slurry into a liquid and solids in the tank;

removing the solids from the tank; and mixing cotton motes with the solids and sorbing free liquid from the solids.

6. The method of claim 5 wherein the onshore well is in the process of being drilled by a drilling rig, the liquid delivered into the onshore well is a drilling mud and the solids comprise drilled solids.

7. The method of claim 5 further comprising disposing of a mixture of the cotton motes and solids.

8. The method of claim 7 wherein disposing of the mixture comprises delivering the mixture to a commercial landfill.

9. The method of claim 8 wherein delivering the mixture comprises hauling the mixture in a truck.

10. The method of claim 5 wherein the onshore well is in the process of being completed by a coiled tubing unit, the liquid delivered into the well is a completion liquid and the solids comprise frac sand and pieces of bridge plug.

11. The method of claim 10 wherein the solids comprise frac sand.

12. The method of claim 11 wherein delivering the mixture comprises hauling the mixture in a truck.

13. The method of claim 6 wherein the solids are rock cuttings created by drilling a wellbore in the earth.

14. A method of completing a subterranean onshore well with a coiled tubing unit after a production string has been cemented therein comprising circulating a completion liquid through the production string and through coiled tubing from the coiled tubing unit and thereby removing solids from the production string;

passing the completion liquid and solids into a tank and separating the completion liquid from the solids;

redelivering the completion liquid from the tank through the production string and through coiled tubing from the coiled tubing unit;

discharging solids from the tank;

mixing cotton motes with the solids and sorbing free liquid from the solids;

disposing of a mixture of the cotton motes and solids by trucking the mixture to a commercial landfill.

* * * * *